US007331142B2

(12) United States Patent
Gerard

(10) Patent No.: US 7,331,142 B2
(45) **Date of Patent: *Feb. 19, 2008**

(54) WINDOW FRAME WITH SHIP AND INSTALL ORIENTATIONS

(75) Inventor: Philip O. Gerard, Ada, MI (US)

(73) Assignee: ODL, Incorporated, Zeeland, MI (US)

( * ) Notice: Subject to any disclaimer, the term of this patent is extended or adjusted under 35 U.S.C. 154(b) by 223 days.

This patent is subject to a terminal disclaimer.

(21) Appl. No.: 11/039,973

(22) Filed: Jan. 21, 2005

(65) Prior Publication Data

US 2005/0126079 A1 Jun. 16, 2005

Related U.S. Application Data

(63) Continuation of application No. 10/042,738, filed on May 24, 2002, now Pat. No. 6,922,946, which is a continuation of application No. 09/412,763, filed on Oct. 1, 1999, now abandoned.

(51) Int. Cl.
*E06B 1/36* (2006.01)

(52) U.S. Cl. ..... 49/505; 49/380

(58) Field of Classification Search ..... 49/380, 49/505; 206/325, 231; 52/204.69, 204.71, 52/656.5, 205

See application file for complete search history.

(56) References Cited

U.S. PATENT DOCUMENTS

| | | | |
|---|---|---|---|
| 3,191,727 | A | 6/1965 | Schmeltz et al. |
| 3,545,135 | A | 12/1970 | Lieber |
| 3,750,358 | A | 8/1973 | Lewkowitz |
| 3,760,543 | A | 9/1973 | McAllister |
| 3,903,669 | A | 9/1975 | Pease, Jr. et al. |
| 3,943,679 | A | 3/1976 | Dissinger |
| 4,006,571 | A | 2/1977 | Bursk |
| 4,021,967 | A | 5/1977 | Mulder et al. |
| 4,246,731 | A | 1/1981 | Miro |
| 4,280,309 | A | 7/1981 | Huelsekopf |
| 4,407,100 | A | 10/1983 | Huelsekopf |
| 4,583,639 | A | 4/1986 | Fedick et al. |
| 4,691,477 | A | 9/1987 | Governale |
| 4,720,951 | A | 1/1988 | Thorn et al. |
| 4,850,168 | A | 7/1989 | Thorn |
| 4,901,493 | A | 2/1990 | Thorn |
| 4,920,718 | A | 5/1990 | Artwick et al. |
| 4,989,381 | A | 2/1991 | De Block et al. |
| 5,133,168 | A | 7/1992 | Neilly et al. |
| 5,251,418 | A | 10/1993 | Jacobs et al. |
| 5,323,579 | A | 6/1994 | Ruff |
| 5,557,899 | A | 9/1996 | Dube et al. |
| 5,570,548 | A | 11/1996 | Hopper |
| 5,644,881 | A | 7/1997 | Neilly |
| 5,894,706 | A | 4/1999 | Herbst |
| 6,101,772 | A | 8/2000 | Leonard et al. |
| 6,272,801 | B1 | 8/2001 | Suh |
| 6,922,946 | B2 * | 8/2005 | Gerard ..... 49/505 |

* cited by examiner

*Primary Examiner*—Gregory J. Strimbu
(74) *Attorney, Agent, or Firm*—Warner Norcross & Judd LLP

(57) ABSTRACT

A window frame including a pair of identical frame halves that can be interconnected without fasteners. Two different connector systems are integrally formed with the frame halves, and the frame halves have two possible orientations with respect to one another—a ship orientation and an install orientation. The first connector system releasably interconnects the frame halves in either orientation. The second connector system essentially permanently interconnects the frame halves only in the install orientation—not in the ship orientation.

12 Claims, 6 Drawing Sheets

WINDOW FRAME WITH SHIP AND INSTALL ORIENTATIONS

This is a continuation of application Ser. No. 10/042,738, filed on May 24, 2002 (now U.S. Pat. No. 6,922,946), which is a continuation of application Ser. No. 09/412,763, filed Oct. 1, 1999 (now abandoned).

BACKGROUND OF THE INVENTION

The present relates to window frames, and more particularly to window frames that can be installed without screws or other fasteners.

Window frames, such as those used in doorlights, are well known. Door light frames in particular typically include two frame halves—one exterior and one interior—that are screwed together or otherwise interconnected. The frame halves are positioned on opposite sides of an object, such as a door, to support a glazing panel such as insulated glass. Illustrative doorlight frames are illustrated in U.S. Pat. No. 5,644,881 issued Jul. 8, 1997 to Neilly; U.S. Pat. No. 5,133,168 issued Jul. 28, 1992 to Neilly et al; U.S. Pat. No. 4,920,718 issued May 1, 1990 to Artwick et al; and U.S. Pat. No. 4,021,967 issued May 10, 1977 to Mulder et al.

Although these doorlight frames enjoy widespread popularity, they can be relatively time-consuming to install. The doorlight assembly is fabricated at one location and shipped to a second location for installation within a door. When the window frame arrives at the second location, the fasteners must be removed; the window frame halves must be separated; the frame halves must be repositioned on opposite sides of the door; and the fasteners must be reinstalled. Given that a typical frame may include fourteen or more screws, a considerable amount of time is required to install the window in the door. Further, such doorlight frames have aesthetic issues because the screw holes and screw heads are visible on the installed frame. Although the holes can be filled with putty or screw hole covers, these remedies require additional time; and the results vary with the skill of the installer.

Some doorlight frames have been developed that do not include threaded fasteners. Examples are illustrated in U.S. Pat. No. 3,903,669 issued Sep. 9, 1975 to Pease et al; and U.S. Pat. No. 3,760,543 issued Sep. 25, 1973 to McAllister. The Pease construction includes fasteners that have two bulbous protrusions, each of which is entrapped within one of the frame halves. The McAllister also includes unthreaded fasteners that fit frictionally within the frame halves.

Unfortunately, the frames without threaded fasteners developed to date are not satisfactory. First, and in the case of the Pease construction, the fasteners cannot be installed in the frames during manufacture of the doorlight and prior to installation in a door. If they were, the frames could not be separated so that the frame could be installed within a door. Second, and in the case of the McAllister construction, the fasteners may provide an inadequate retaining function, such that the frame halves may unintentionally separate. In other words, if the unthreaded fasteners provide adequate permanent intersecurement, they cannot be installed prior to the installation of the doorlight within the door.

SUMMARY OF THE INVENTION

The aforementioned problems are overcome in the present invention wherein a window frame includes two interconnecting systems—one for temporarily interconnecting two frame halves during shipment and the other for permanently interconnecting the frame halves once installed. The frame halves can be oriented with respect to one another in either a "ship" orientation or an "install" orientation. The frame halves can be moved between the two orientations by rotating one of the frame halves by 180 degrees. The frame includes a first connector system for releasably interconnecting the frame halves in either of the two orientations. The frame further includes a second connector system for permanently interconnecting the frame halves only when they are in the "install" orientation.

The first connector system releasably interconnects the two frames in either orientation. The second connector system permanently interconnects the frame halves only in the install orientation. Consequently, when the frame halves are in the ship orientation, they will not separate during shipment and handling, but can be separated when they are to be installed. Prior to installation within a door, the orientation of the frames is changed from the ship orientation to the install orientation wherein the second connector system becomes operative. As the frames are pushed back together, the second connector system essentially permanently intersecures the two frame halves.

In a preferred embodiment of the invention, the second connector system includes a plurality of barbs and a plurality of keepers integrally formed with the first and second frame halves. In this embodiment, separate fasteners—either threaded or unthreaded—are not required, simplifying and reducing the cost of both the manufacturing step and the installation step.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 3:
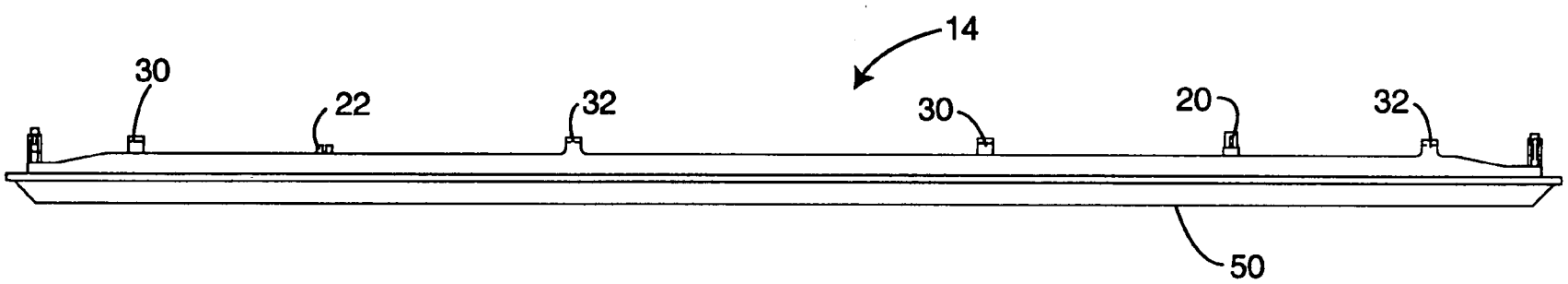
FIG. 3 is a side elevational view of the frame half.
Figure 4:
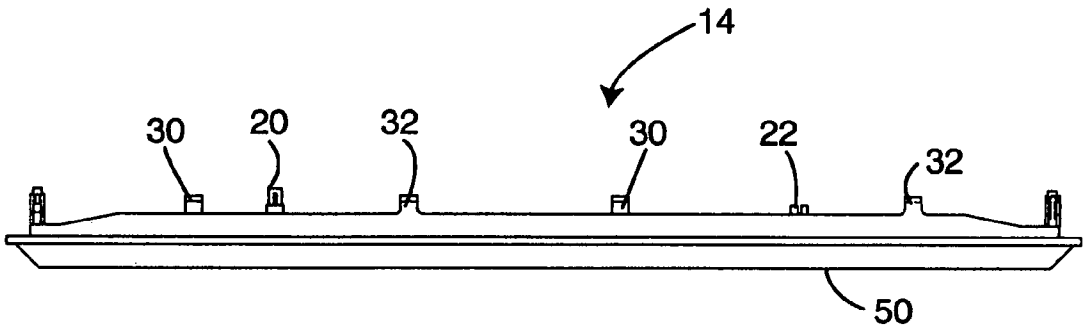
FIG. 4 is an end elevational view of the frame half.

A doorlight constructed in accordance with a preferred embodiment of the invention is illustrated in the drawings and generally designated 10. The doorlight includes an insulated glass 12 and a pair of identical frame halves 14 and 16. The frame halves 14 and 16 have a first connector system including male pieces 20 and female pieces 22 (see FIGS. 3 and 4). These components provide a friction fit when the frame halves are pushed together to releasably interconnect the frame halves in either a "ship" orientation or an "install" orientation. The frame halves 14 and 16 also have a second connector system including barbs 30 and receivers or keepers 32. These pieces interfit only when the frame halves are in the install orientation to permanently interconnect the two frame halves. Consequently, the frame halves (1) are releasably interconnected by the first connecting system when the frame halves are in either the ship orientation or the install orientation and (2) are permanently interconnected by the second connecting system only when the frame halves are in the install orientation.

The insulated glass 12 is well known to those skilled in the art and includes a pair of window panes or panels 40 and 42 separated by a spacer 44. The two panes 40 and 42 are adheringly secured to the spacer 44 about the entire perimeter of the insulated glass 12. The space between the panes may be filled with an inert gas to enhance the thermal insulation effect. Other glazing panels, for example fabricated of glass, polycarbonate, acrylic, or other transparent or translucent materials, may be substituted for the insulated glass 12.

The two window frame halves 14 and 16 are generally identical to one another and together comprise a single window frame. Because the two frame halves are identical, only the frame half 14 will be described in detail.

The frame half 14 is a single integral piece injection molded of polystyrene. Other suitable plastics or other materials may be used in place of the polystyrene. Such materials are and will be known to those skilled in the art.

The frame includes an exposed surface 50 which provides a molding appearance. Appropriate shapes for the exterior surface 50 are and will be known to those skilled in the art. Often, the surface is configured and/or textured to simulate the appearance of wood molding.

As is customary, the frame half 14 includes a door engagement portion 60 and a glass engagement portion 62. Each of the support portions 60 and 62 defines a channel (not numbered) facing the door D or glass 12, respectively. A caulk or other sealant may be installed within the grooved to enhance sealing against the respected components. The use of caulk is standard on the exterior side of the door and glass and optional on the interior side of the door and glass.

Figure 1:
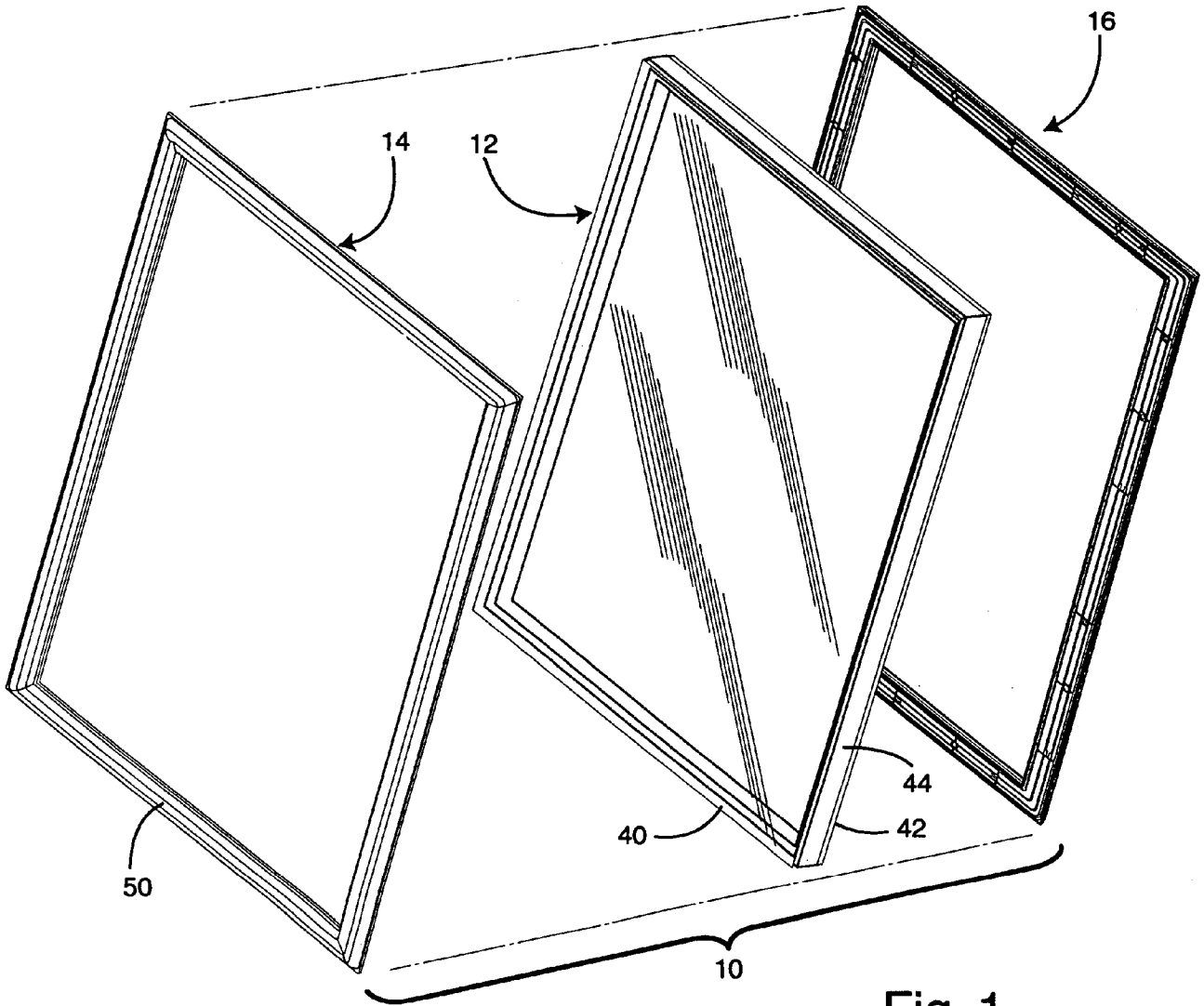
FIG. 1 is a perspective exploded view of a doorlight incorporating the window frame of the present invention.
Figure 2:
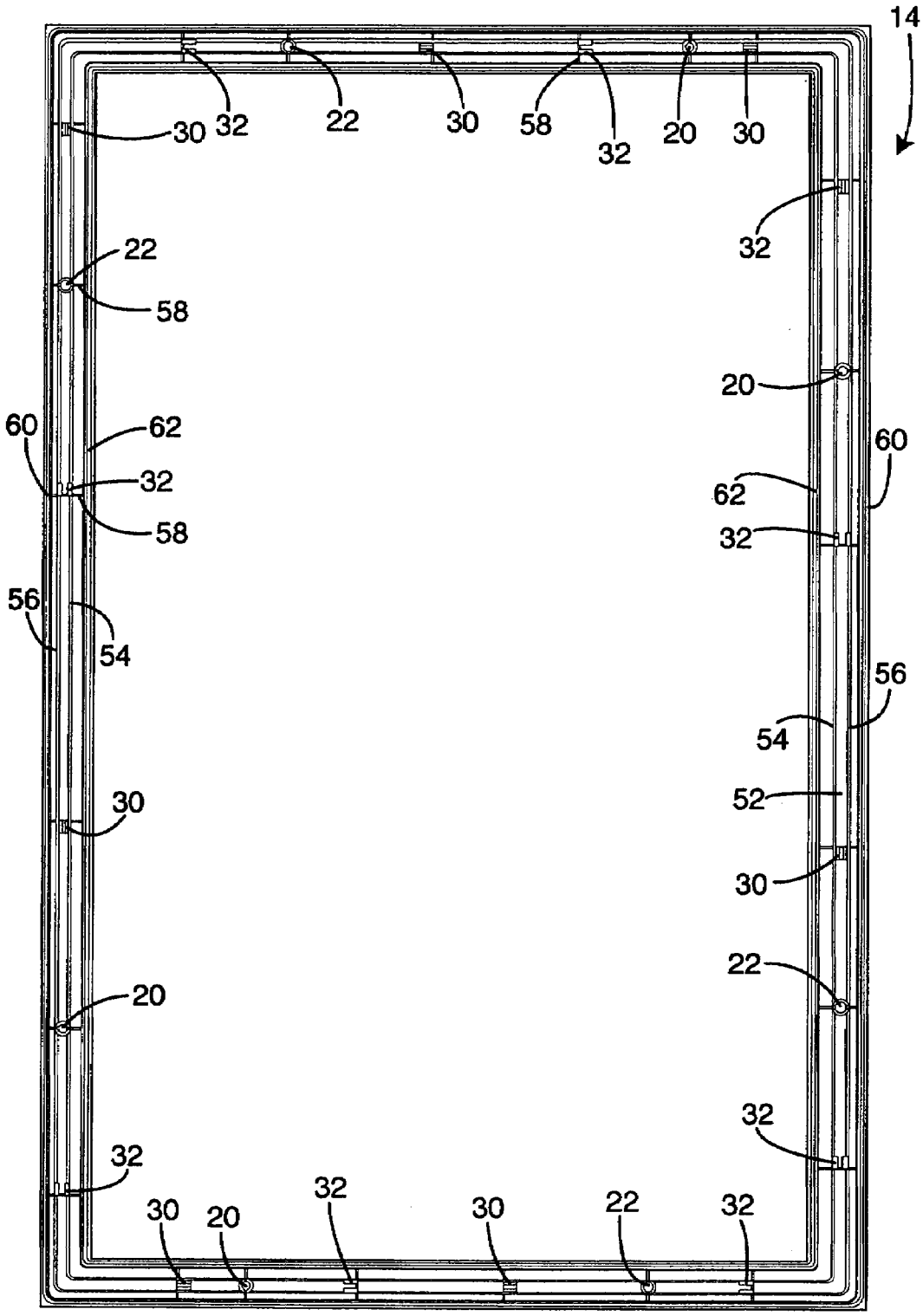
FIG. 2 is an interior plan view of one of the doorlight frame halves.

The underside 52 of the frame half 14 is perhaps best illustrated in FIG. 2. This side of the frame includes a pair of integrally molded reinforcing ribs 54 and 56, which extend around the entire perimeter of the frame half 14. Lateral or transverse ribs 58 are spaced around the perimeter of the frame half 14 and are perpendicular to the longitudinal ribs 54 and 56. All of the ribs provide enhanced structural integrity for the frame half 14, and they also support the other frame components discussed below. Because the frame half is a single-injection molded component, the ribs 54, 56, and 58 are integral with the frame and with one another.

The first connector system includes a plurality of pins 20 and sockets 22 around the perimeter of the frame half 14. The use of such integral pins and sockets is well known as illustrated in U.S. Pat. No. 5,644,881 issued Jul. 8, 1997 to Neilly, the disclosure of which is incorporated by reference. The pins 20 and sockets 22 provide a friction fit with one another and cooperate to releasably intersecure the two frame halves 14 and 16.

Figure 7:
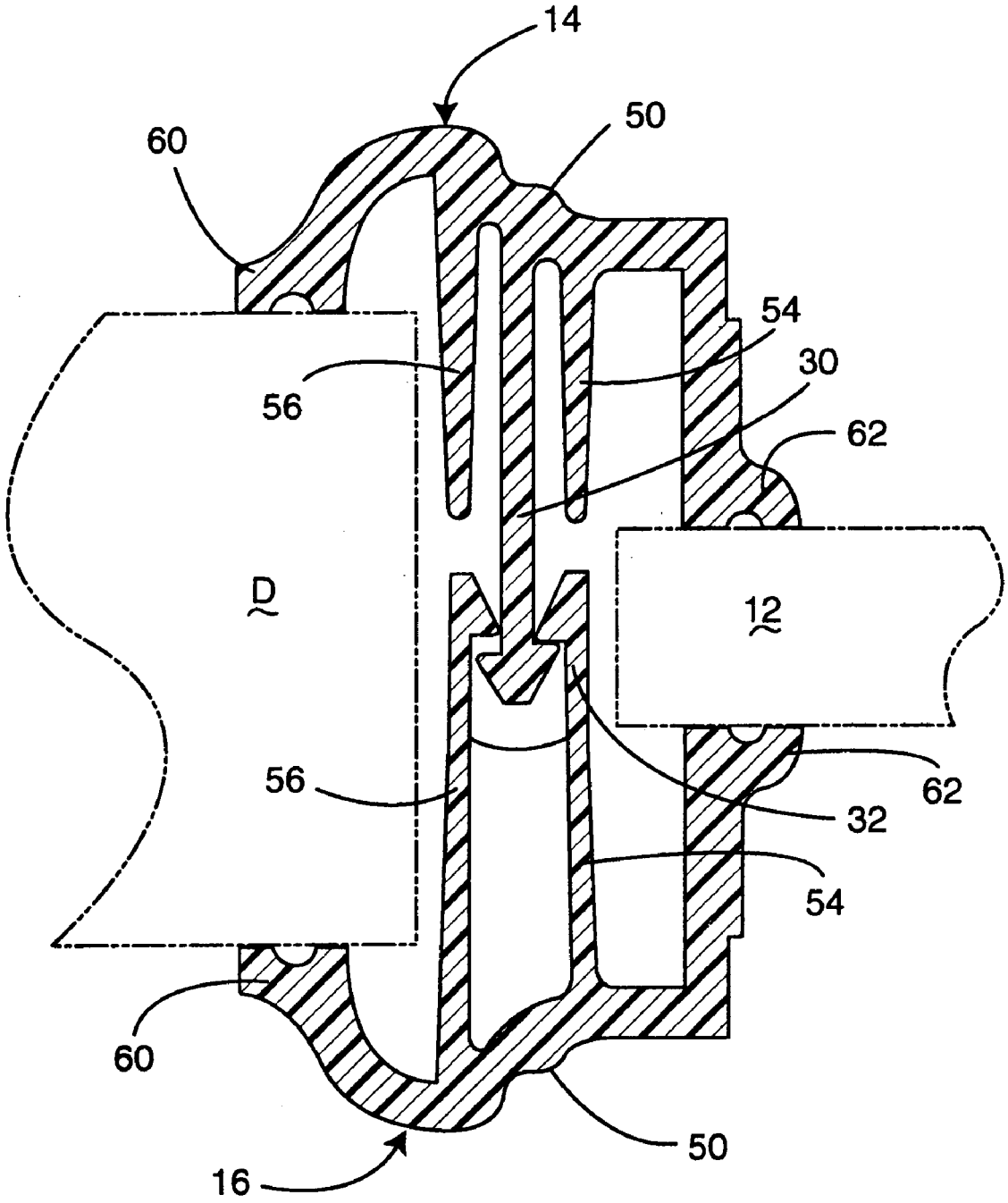
FIG. 7 is a sectional view taken along line VII-VII in FIG. 6.
Figure 8:
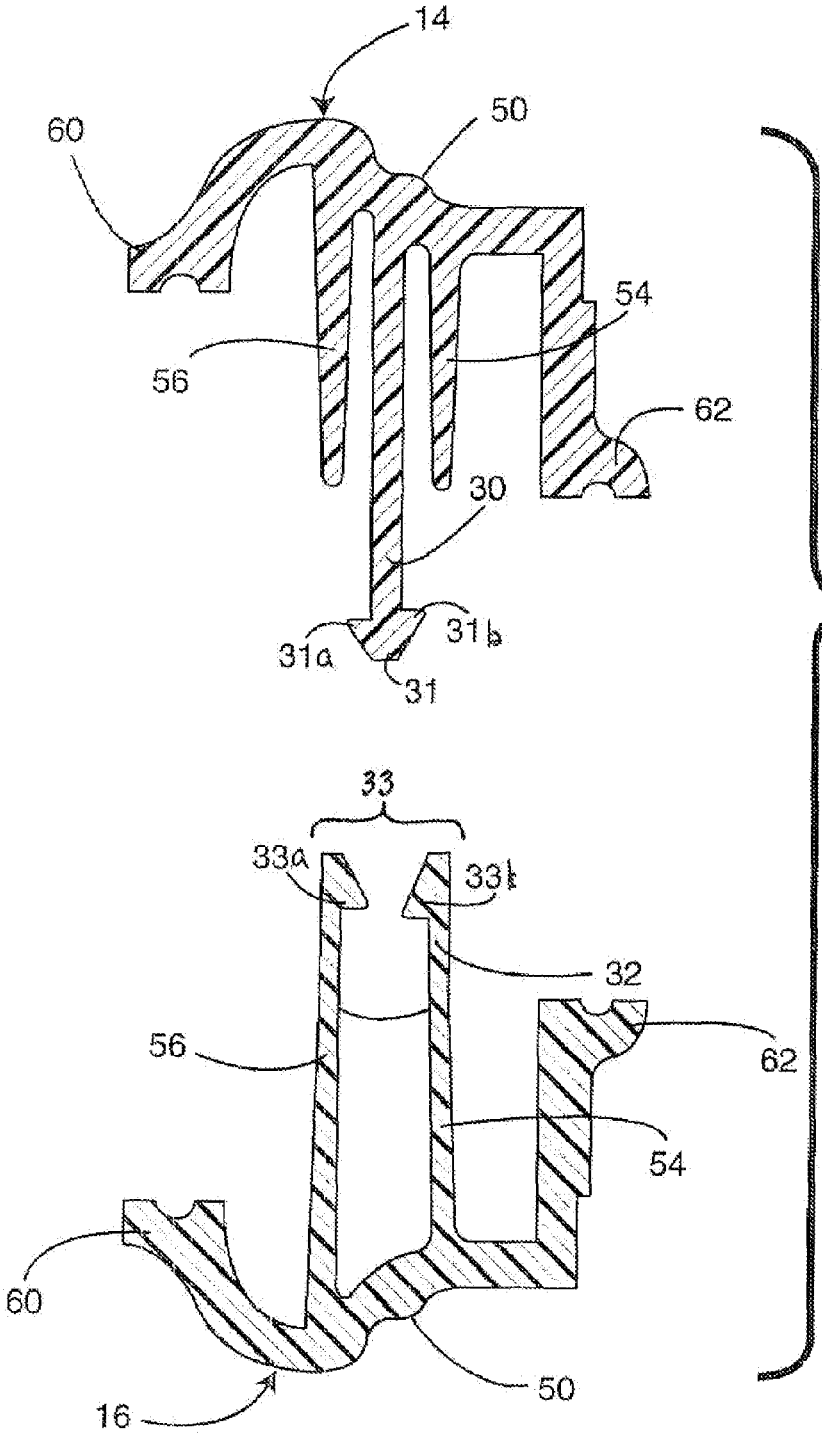
FIG. 8 is a sectional view similar to FIG. 7, but with the two frame halves separated from one another.

The second connector system includes a plurality of barbs 30 and receivers or keepers 32 spaced about the perimeter of the frame half 14. FIGS. 7-8 illustrate the second connector system in greater detail. Each of the barbs 30 terminates in a barb head 31 having a pair of barb prongs 31*a* and 31*b* at different axial locations along the barb. Each of the keepers 32 terminates in a keeper portion 33 having keeper prongs 33*a* and 33*b* at different axial locations along the keeper. The axial distance between the barb prongs 31*a* and 31*b* is different from the axial distance between the keeper prongs 33*a* and 33*b*. Accordingly, the prongs 31*a* and 33*a* interlock at a first relative axial position of the barb and keeper; and the prongs 31*b* and 33*b* interlock at a second relative axial position of the barb and keeper.

The two frames halves 14 and 16 may be oriented with respect to one another in either a "ship" orientation or an "install" orientation. In both orientations, the rectangular frame halves 14 and 16 aligned with and overlie one another. The frame halves are moved from the ship orientation to the install orientation by removing one frame half from the other, rotating that frame half 180 degrees within its plane, and rejoining the frame halves.

Figure 5:
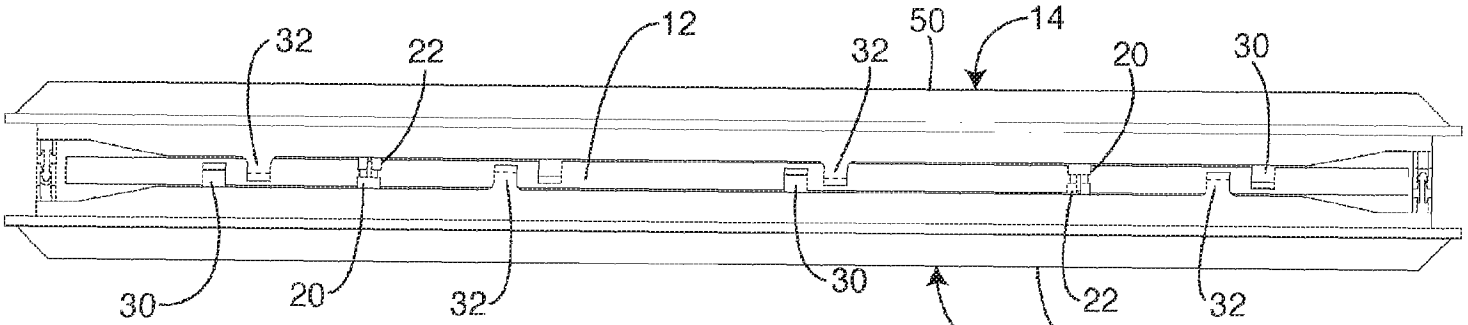
FIG. 5 is an end elevational view of the assembled frame in the ship orientation.
Figure 6:
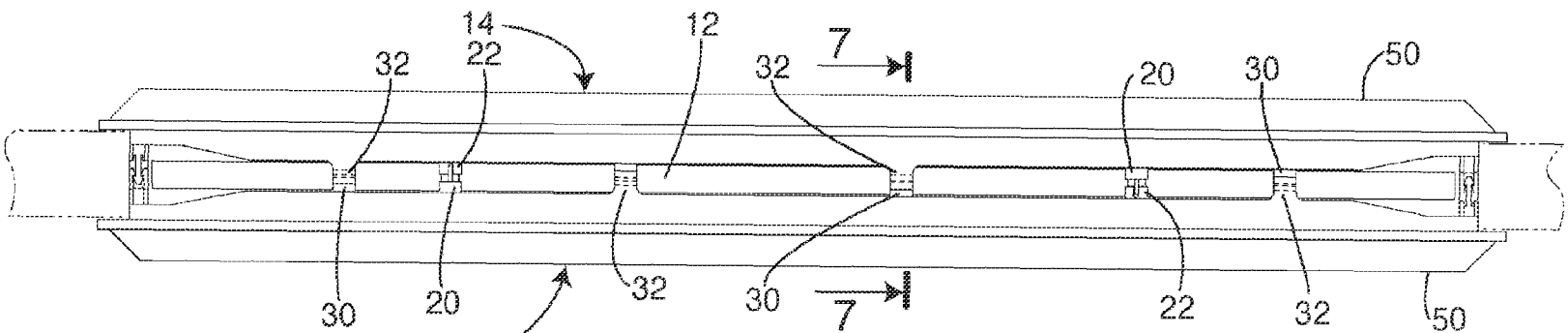
FIG. 6 is a end elevational view of the assembled frame in the install orientation.

The barbs 30 and keepers 32 are spaced about the frame halves 14 and 16 so that they "miss" one another when the frame halves are in the ship orientation, as illustrated in FIG. 5. The barbs 30 and keepers 32 lockingly interfit to essentially permanently intersecure the frame halves when they are in their install orientation as illustrated in FIGS. 6-7. When the frame halves 14 and 16 are fully pushed together against the door D and the glass 12, each barb head 31 locks within a keeper head 33 to essentially permanently interconnect the two frame halves.

ASSEMBLY AND USE

The frame halves 14 and 16 are injection molded using known techniques. The insulated glass 12 also is fabricated using known techniques. To assemble the window assembly 10 for shipment, one frame half 16 is laid on a support surface. The insulated glass 12 is laid within the frame half and specifically on the glass support portion 62. The other frame half 14 is oriented in the ship orientation and forced downwardly onto the frame 16. In the ship position, the first connector system is effective, but the second connector system is not effective. Specifically, the pins 20 frictionally fit within the sockets 22 to releasably interconnect or intersecure the frame halves 14 and 16. The barbs 30 and keepers 32 miss one another as illustrated in FIG. 5.

The assembled doorlight 10 is shipped to a door manufacturer, door pre-hanger, or door distributor for installation in a door. The doorlight installer separates the frames halves 14 and 16 from one another. The friction fit provided by the pins 20 and sockets 22 enables the frame halves to be readily separated by hand. One frame half with the glass 12 therein is positioned on a support surface. A door D is laid over the frame so as to engage the support portion 60. The removed frame half is rotated 180 degrees so that it is moved from the ship orientation to the install orientation. The frame half is then forced down onto the frame half 16.

As the frame halves move together, the first connector system acts as an alignment system with the pins 20 passing into the sockets 22. As the frame halves 14 and 16 are further urged toward one another, the barbs 30 eventually enter the keepers 32 until the barb heads 31 snap behind the keeper heads 33. As the barbs pass into the keepers, first the barb prongs 31 a snap behind the keeper prongs 33*a*; and second—and usually—the barb prongs 31*b* snap behind the keeper prongs 33*b*. Because the barbs and keepers are capable of interlocking at a plurality of relative axial positions and because the frame halves 14 and 16 can flex, the frame halves are capable of accommodating doors of different nominal thickness. The pressure required to fully close the frame halves and lock the barbs and keepers together can be provided by hand, by a rubber mallet, or by a mechanical press. The second connector system essentially permanently interconnects the frame halves 14 and 16 to maintain the glazing panel 12 in position with respect to the door D. "Essentially permanently" or "securely" means that the frame halves can be separated with either (1) some type of tool or release mechanism or (2) a force beyond the manual capability of most human beings.

The above description is that of a preferred embodiment of the invention. Various alterations and changes can be made without departing from the spirit and broader aspects of the invention as defined in the appended claims, which are to be interpreted in accordance with the principles of patent law, including the doctrine of equivalents.

The invention claimed is:

1. A window frame comprising:

a first frame half;

a second frame half having a ship orientation and an install orientation with respect to said first frame half, said second frame half being moved between the ship and install orientations by rotating said second frame half within its own plane with respect to said first frame half;

a glazing panel disposed between said first frame half and said second frame half in both the ship orientation and the install orientation of the second frame half;

alignment means for releasably aligning said first and second frame halves when said second frame half is in the ship orientation, said alignment means being integral and one piece with said first and second frame halves; and connector means for securely interconnecting said first and second frame halves only when said second frame half is in the install orientation, said connector means also being integral and one piece with said first and second frame halves, said connector means being aligned in the install orientation of said second frame half and being unaligned in the ship orientation of said second frame half.

2. A window frame as described in claim 1 wherein said first and second frame halves are identical to one another.

3. A window frame as defined in claim 1 wherein said connector means includes barbs and keepers and a keeper.

4. A window frame as defined in claim 3 wherein said barbs and said keepers are capable of interlocking at a plurality of relative axial positions.

5. A window frame as defined in claim 1 wherein said alignment means includes friction fitting components.

6. A window frame comprising:

a first frame half;

a second frame half including a ship orientation and an install orientation with respect to said first frame half, said second frame half being moved between the ship orientation and the install orientation by turning said second frame half within its own plane with respect to said first frame half;

a glazing panel disposed between said first frame half and said second frame half in both the ship orientation and the install orientation of the second frame half;

alignment means unitary and one piece with said first and second frame halves for releasably aligning said first and second frame halves when said second frame half is in the ship orientation ; and connector means unitary and one piece with said first and second frame halves for securely interconnecting said first and second frame halves, said connector means operative only when said second frame half is in the install orientation said connector means being aligned in the install orientation of said second frame half and being unaligned in the ship orientation of said second frame half.

7. A window frame as defined in claim 6 wherein said first and second frame halves are identical to one another.

8. A window frame as defined in claim 6 wherein said connector means includes barbs and keepers.

9. A window frame as defined in claim 8 wherein said barbs and said keepers are capable of interlocking at a plurality of relative axial positions.

10. A window frame as defined in claim 6 wherein said alignment means includes friction fitting components.

11. A window frame comprising:

a first frame half;

a second frame half having a ship orientation and an install orientation with respect to said first frame half, said second frame half being interchangeable between the ship and install orientations by rotating said second frame half within its own plane with respect to said first frame half;

a glazing panel disposed between said first frame half and said second frame half in both the ship orientation and the install orientation of the second frame half;

alignment means for releasably aligning said first and second frame halves when the second frame half is in the ship orientation, said alignment means including first and second portions monolithically formed with said first and second frame halves, respectively; and connector means for essentially permanently interconnecting said first and second frame halves only when said second frame half is in the install orientation, said connector means being inoperative when said second frame half is in the ship orientation, said connector means including first and second portions monolithically formed with said first and second frame halves, respectively said first and second portions of said connector means being aligned in the install orientation of said second frame half and being unaligned in the ship orientation of said second frame half.

12. A window frame as defined in claim 11 wherein said first and second frame halves are identical to one another.

* * * * *

UNITED STATES PATENT AND TRADEMARK OFFICE

CERTIFICATE OF CORRECTION

PATENT NO. : 7,331,142 B2
APPLICATION NO. : 11/039973
DATED : February 19, 2008
INVENTOR(S) : Philip O. Gerard It is certified that error appears in the above-identified patent and that said Letters Patent is hereby corrected as shown below:

Column 5, Claim 3, Line 39:
after "keepers" delete "and a keeper"

Signed and Sealed this

Twenty-seventh Day of May, 2008

JON W. DUDAS
*Director of the United States Patent and Trademark Office*